US006744189B2

(12) United States Patent
Honda

(10) Patent No.: US 6,744,189 B2
(45) Date of Patent: Jun. 1, 2004

(54) SPARK PLUG

(75) Inventor: Toshitaka Honda, Iwakura (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/189,516

(22) Filed: Jul. 8, 2002

(65) Prior Publication Data

US 2003/0030355 A1 Feb. 13, 2003

(30) Foreign Application Priority Data

Jul. 6, 2001 (JP) ..... 2001-206711

(51) Int. Cl.[7] ..... H01T 13/20

(52) U.S. Cl. ..... 313/143; 313/140; 313/141; 313/118

(58) Field of Search ..... 313/140, 141, 313/143, 118

(56) References Cited

U.S. PATENT DOCUMENTS 6,509,676 B1 * 1/2003 Durling ..... 313/137
6,590,318 B2 * 7/2003 Nishikawa et al. ..... 313/143

FOREIGN PATENT DOCUMENTS

EP 0 959 542 A1 11/1999
JP 2-239582 9/1990

* cited by examiner

*Primary Examiner*—Sandra O'Shea
*Assistant Examiner*—Sumati Krishnan
(74) *Attorney, Agent, or Firm*—Sughrue Mion, PLLC

(57) ABSTRACT

A spark plug 100 is configured such that an insulator 2 is formed of alumina ceramic, and the diameter of a through-hole 6 is not greater than 4 mm as measured at a position where conductive seal materials 16 and 17 are disposed. The coefficient of linear expansion of the conductive seal materials 16 and 17 is adjusted to not greater than $6.5\times10^{-6}$/° C.

9 Claims, 9 Drawing Sheets

3
6b
2d'
2
6a
6
H
28
27
25
26

SPARK PLUG

BACKGROUND OF THE INVENTION

1. Field of the Invention

The present invention relates to a spark plug for use in an internal combustion engine.

2. Description of the Related Art

Conventionally, there has been used widely a spark plug configured such that a metallic terminal member is inserted into one end portion of a through-hole formed axially in an insulator; a center electrode is inserted into the other end portion of the through-hole; and the metallic terminal member and the center electrode are securely and rigidly held within the through-hole in a sealed condition by use of a conductive seal material. Within the through-hole formed in the insulator, the metallic terminal member and the center electrode may be connected directly to each other by means of the conductive seal material or may be connected such that a resistor is sandwiched between a conductive seal material layer on the side of the metallic terminal member and that on the side of the center electrode. The conductive seal material is generally a mixture of metal and base glass; specifically, metallic particles are dispersed within glass matrix in network-like contact with one another, thereby imparting an electrically conductive property to glass, which in itself is electrically insulative, through assuming the form of a composite material.

In recent years, most insulators for use in spark plugs have been formed of alumina ceramic, which exhibits excellent dielectric strength. Meanwhile, the metallic terminal member or the center electrode is formed of a metal that contains a predominant amount of, for example, Fe or Ni. Thus, the insulator has a coefficient of linear expansion which greatly differs from that of the metallic terminal member or that of the center electrode (e.g., alumina has a coefficient of linear expansion of about $7.3\times10^{-6}$/° C., whereas Fe and Ni have a coefficient of linear expansion of about $12–14\times10^{-6}$/° C.). Therefore, for example, in the course of use, when a spark plug heated to high temperature is cooled, the metallic terminal member or the center electrode contracts by a greater amount than does the insulator. In this case, if the conductive seal material fails to follow the contraction, the material may suffer separation or a like defect. Conventionally, the conductive seal material is a mixture of metal and glass (inorganic material) so as to assume an intermediate coefficient of linear expansion between the coefficient of linear expansion of the insulator and that of the metallic terminal member or the center electrode, thereby reducing a contraction difference therebetween to a certain extent.

However, in recent years, engines to which spark plugs are applied have tended to have high output accompanying an increase in compression ratio of an air-fuel mixture, thereby requiring seal materials to provide higher sealing performance. Further, in recent engines, a mechanism around a cylinder head, on which spark plugs are mounted, has become complicated, and thus a mounting space for spark plugs tends to be narrowed. Therefore, a reduction in spark plug size has been strongly required. A reduction in spark plug size leads to a reduction in insulator size and thus a reduction in the diameter of a through-hole formed in the insulator. Accordingly, when the combustion pressure of an engine is imposed on the center electrode of such a size-reduced spark plug, force per unit area to be imposed on the seal material provided within the through-hole increases. In view of this increase as well as an increase in compression ratio of an air-fuel mixture, conventional specifications of a conductive seal material are becoming insufficient for satisfying durability requirements.

SUMMARY OF THE INVENTION

An object of the present invention is to provide a spark plug capable of providing sufficiently high sealing performance by means of a conductive seal material even when the diameter of a through-hole formed in an insulator is small, and capable of achieving sufficient durability even in application to an engine of high output.

In order to achieve the above object, the present invention provides a spark plug in which a metallic terminal member and a center electrode are securely and rigidly held, via a conductive seal material, within a through-hole formed axially in an insulator, characterized in that the insulator is formed of alumina ceramic; the diameter of the through-hole is not greater than 4 mm as measured at a position where the conductive seal material is disposed; and a coefficient of linear expansion of the conductive seal material is adjusted to not greater than $6.8\times10^{-6}$/° C. In the present invention, alumina ceramic contains alumina in an amount not less than 80% by mass, and the coefficient of linear expansion is that obtained by averaging those at 20° C.–350° C.

As mentioned previously, alumina used to form an insulator has a coefficient of linear expansion of about $7\times10^{-6}$/° C.; and a conventional spark plug employs a conductive seal material (hereinafter may be referred to merely as a seal material) having an intermediate coefficient of linear expansion between the coefficient of linear expansion of alumina and that of a metal used to form a metallic terminal member or a center electrode. In this case, in the course of cooling from high temperature, as shown in FIG. 8(*a*), the seal material contracts by a greater amount than does the insulator formed of alumina ceramic; as a result, tensile stress, which is induced by differential contraction between the seal material and the insulator, is likely to remain in the seal material at its surface of bonding to the insulator on the inner surface of a through-hole formed in the insulator, resulting in a likelihood of, for example, the seal material being cracked or separated from the insulator. Accordingly, when a small-sized spark plug whose through-hole has a diameter not greater than 4 mm is applied to, for example, an engine to be operated at high output and high compression ratio, the spark plug fails to exhibit sufficient durability. When the seal material contracts radially to a considerable extent, the seal material separates from the inner surface of the through-hole formed in the insulator, possibly resulting in impaired gastightness or impaired durability of the seal material itself.

However, according to a first configuration of the spark plug of the present invention, the coefficient of linear expansion of the seal material is adjusted to be lower than that of alumina; specifically, to be less than $6.8\times10^{-6}$/° C. Therefore, as shown in FIG. 8(*b*), in the course of cooling, the relationship in amount of contraction between the seal material and the insulator is reversed from that of the conventional spark plug; i.e., compression stress, which is advantageous for suppression of propagation of cracking, remains in the seal material. As a result, even when a small-sized spark plug whose through-hole has a diameter not greater than 4 mm is applied to an engine to be operated at, for example, high output and high compression ratio, a bond portion of the seal material can exhibit sufficient durability, and thus good gastightness can be maintained over a long period of time. Also, radial contraction of the seal material is suppressed, thereby avoiding a likelihood of the seal material being separated from the inner surface of the through-hole formed in the insulator with resultant formation of clearance. Preferably, the coefficient of linear expansion of the seal material is adjusted to not greater than $6.5\times10^{-6}$/° C.

When the coefficient of linear expansion of the seal material is not less than $6.8\times10^{-6}$/° C., the above-described effect is not sufficiently yielded. No particular limitation is imposed on the lower limit of the coefficient of linear expansion of the seal material; however, the lower limit that is attainable through selection of material exists of its own accord. The present inventors have confirmed from studies that there can be implemented a seal material having a coefficient of linear expansion that is lowered to, for example, about $3.0\times10^{-6}$/° C.

The conductive seal material can specifically contain base glass, a conductive filler, and an insulative filler, and, in order to impart the above-described coefficient of liner expansion to the conductive seal material, the insulative filler can contain an inorganic material having a coefficient of linear expansion lower than that of aluminum oxide. Preferably, in order to suppress the coefficient of linear expansion of the conductive seal material to a lower level, the insulative filler is formed of an inorganic material having a coefficient of linear expansion lower than that of the base glass.

As in the case of a conventional conductive seal material, the base glass can be glass that contains a predominant amount of oxide, such as borosilicate glass. In this case, an insulative filler formed of an oxide-type inorganic material exhibits enhanced affinity to the base glass and is thus advantageous for realizing a seal structure of excellent strength and gastightness. For example, one or more substances selected from the group consisting of β-eucryptite, β-spodumene, keatite, silica, mullite, cordierite, zircon, and aluminum titanate can be favorably used as such an oxide-type inorganic material in the present invention.

When an insulative filler to be used is formed of an oxide-type inorganic material having a coefficient of linear expansion lower than that of aluminum oxide, preferably, in the microstructure of the conductive seal material as observed on a cross section thereof, insulative filler particles having a particle size of 100–350 μm occupy an area percentage of 2–40% in the microstructure. Notably, herein, the particle size in the context "the particle size of an insulative filler particle as observed in the microstructure of a cross section" is represented by the diameter of a circle having an area identical to that of the particle appearing on the cross section.

Use of an insulative filler formed of an oxide-type inorganic material having a coefficient of linear expansion lower than that of aluminum oxide can appropriately lower the coefficient of linear expansion of the conductive seal material below that of the insulator formed of alumina ceramic, and is thus advantageous for maintaining durability of a bond portion of the seal material. The above-described adjustment of the form of presence of the insulative filler as observed in the microstructure of a cross section of the seal material considerably enhances the sealing performance and durability of the seal material. Thus, for example, even when a small-sized spark plug whose through-hole has a diameter not greater than 4 mm is applied to an engine to be operated at high output and high compression ratio, the spark plug can maintain good gastightness over a long period of time.

When, in the microstructure of the seal material as observed on a cross section thereof, insulative filler particles having a particle size of 100–350 μm occupy an area percentage less than 2%, this indicates that, among insulative filler particles formed of an oxide-type inorganic material, those of small particle sizes (e.g., those having a particle size less than 50 μm) are melted into the base glass in a sealing step performed through application of heat. As a result, the softening point of the seal material increases excessively, with a resultant failure to provide good sealing performance or failure to impart sufficient bonding strength to a bond portion of the seal material. When the area percentage exceeds 40%, this indicates that excessive insulative filler particles are contained, thereby impairing fluidity of the seal material in the course of softening, with a resultant failure to provide good sealing performance or failure to impart sufficient bonding strength to a seal portion.

Figure 1:
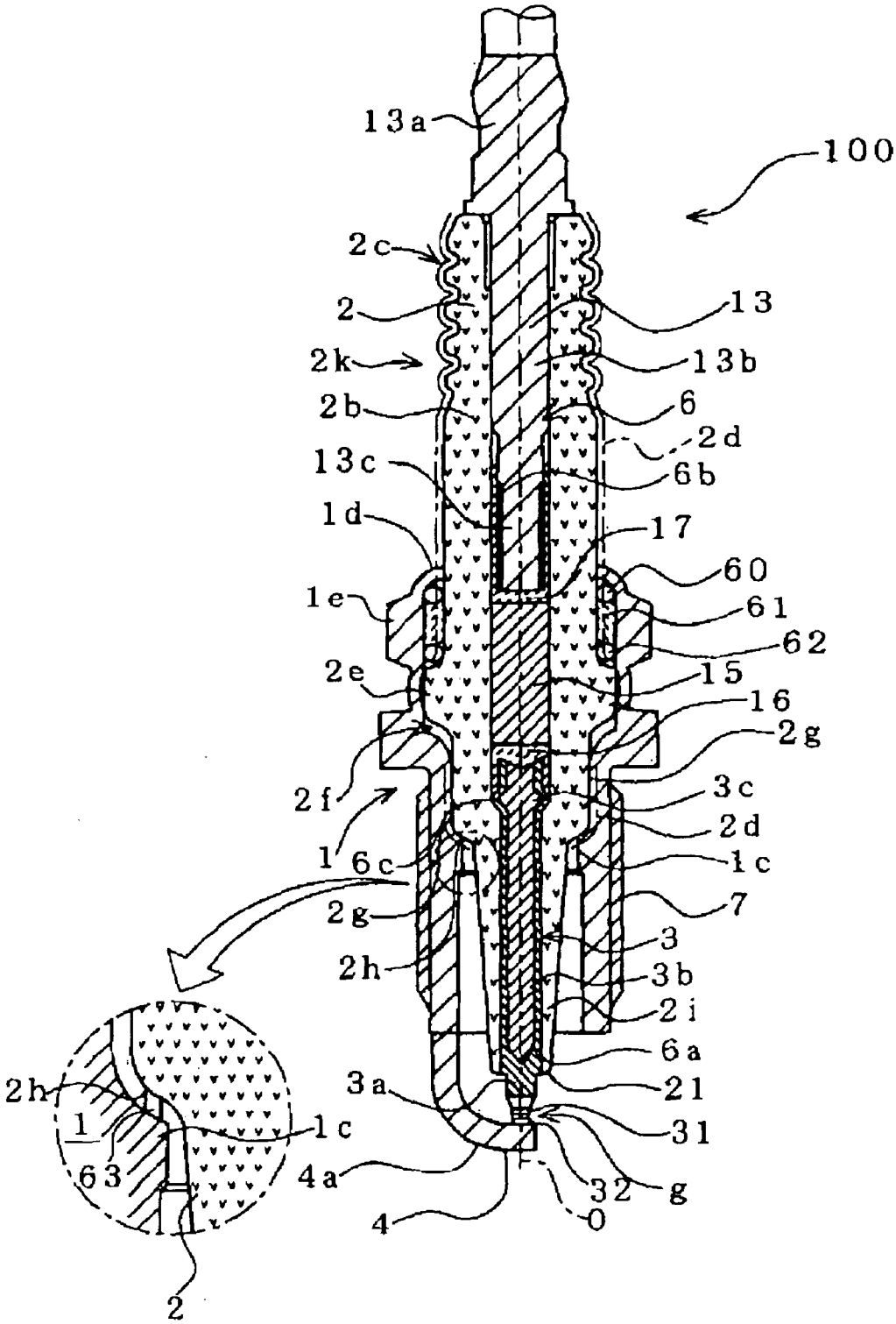
FIG. 1 is a vertical sectional view showing an embodiment of a spark plug of the present invention.

Reference numerals are used to identify some items shown in the drawings as follows:

1: metallic shell
2: insulator
3: center electrode
4: ground electrode
13: metallic terminal member
16, 17: conductive seal material layers

DESCRIPTION OF THE PREFERRED EMBODIMENTS

FIG. 1 shows an embodiment of a spark plug according to the present invention. The spark plug 100 includes a cylindrical, metallic shell 1; an insulator 2, which is fitted into the metallic shell 1 such that a tip portion 21 projects from the metallic shell 1; a center electrode 3, which is disposed inside the insulator 2 such that a spark portion 31 formed at the tip thereof projects from the insulator 2; and a ground electrode 4, whose one end is jointed to the metallic shell 1 through, for example, welding and whose opposite end is bent laterally such that a side face thereof faces a tip portion of the center electrode 3. A spark portion 32 is formed on the ground electrode 4 in opposition to the spark portion 31, and the gap between the facing spark portions 31 and 32 serves as a spark discharge gap g.

The metallic shell 1 is formed of a metal, such as low-carbon steel, into a cylindrical shape, and serves as a housing of the spark plug 100. A male-threaded portion 7 is formed on the outer circumferential surface of the metallic shell 1 and adapted to mount the plug 100 onto an unillustrated engine block. Reference numeral 1*e* denotes a tool engagement portion to allow engagement with a tool such as a spanner or a wrench. The tool engagement portion 1*e* assumes a hexagonal cross section.

The insulator 2 has a through-hole 6 formed axially therein for allowing insertion of the center electrode 3 therein, and is formed of an insulating material. The insulating material is dominantly of alumina; specifically, the insulating material assumes the form of a sintered body of alumina ceramic that contains an Al component in an amount of 80–98 mol % (preferably 90–98 mol %) as reduced to $Al_2O_3$.

The insulating material can contain, in addition to the Al component, one or more components selected from among an Si component, a Ca component, an Mg component, a Ba component, and a B component, in the following amounts:

Si component: 1.50–5.00 mol % as reduced to $SiO_2$;

Ca component: 1.20–4.00 mol % as reduced to CaO;

Mg component: 0.05–0.17 mol % as reduced to MgO;

Ba component: 0.15–0.50 mol % as reduced to BaO; and

B component: 0.15–0.50 mol % as reduced to $B_2O_3$.

The insulator 2 has a circumferential protrusion 2*e* formed at an axially intermediate position thereof, for example, in such a manner as to project radially outward along the circumferential direction thereof to thereby assume the form of a flange. In the insulator 2, when the term "front" refers to the side toward the tip of the center electrode 3 (FIG. 1), a portion extending rearward froth the circumferential protrusion 2*e* is a body portion 2*b* having a diameter smaller than that of the circumferential protrusion 2*e*. Also, a first shaft portion 2*g* having a diameter smaller than that of the circumferential protrusion 2*e* extends frontward from the circumferential protrusion 2*e*, and a second shaft portion 2*i* having a diameter smaller than that of the first shaft portion 2*g* extends frontward from the first shaft portion 2*g*. A rear end part of the body portion 2*b* is formed into a corrugation portion 2*c*, and a glaze layer 2*d* is formed on the outer circumferential surface of the corrugation portion 2*c*. The outer circumferential surface of the first shaft portion 2*g* is formed into a substantially cylindrical shape. The outer circumferential surface of the second shaft portion 2*i* is formed into a substantially conical shape such that the diameter reduces toward the tip thereof.

The through-hole 6 formed in the insulator 2 includes a substantially cylindrical first portion 6*a*, which allows insertion of the center electrode 3 therein, and a substantially cylindrical second portion 6*a*, which extends rearward (upward in FIG. 1) from the first portion 6*a* and has a diameter greater than that of the first portion 6*a*. The second portion 6*b* accommodates the metallic terminal member 13 and a resistor 15, and the center electrode 3 is inserted into the first portion 6*a*. An electrode fixation protrusion 3*c* projects radially outward from the outer circumferential surface of a rear end portion of the center electrode 3, and is adapted to fix the center electrode 3 in place. The first portion 6*a* of the through-hole 6 and the second portion 6*b* of the through-hole 6 are connected to each other within the first shaft portion 2*g* in FIG. 3(*a*). At the position of the connection, a protrusion reception seat 6*c* in the form of a tapered surface or a rounded surface is formed in order to receive the electrode fixation protrusion 3*c* of the center electrode 3.

The outer circumferential surface of a transitional portion 2*h* for transition between the first shaft portion 2*g* and the second shaft portion 2*i* is formed into a stepped surface. The stepped surface of the transitional portion 2*h* is engaged, via an annular sheet packing 63, with a circumferential, inward protrusion 1*c* formed on the inner surface of the metallic shell 1 and serving as an engagement portion on the metallic-shell side, thereby preventing axial slipping-off of the insulator 2. A ring-shaped thread packings 60 and 62 are disposed between the inner surface of a rear opening portion of the metallic shell 1 and the outer surface of the insulator 2 such that the packing 62 is fitted onto the insulator 2 along the rear circumferential edge of the flange-like circumferential protrusion 2*e*, and the packing 60 is fitted onto the insulator 2 apart rearward from the packing 62 with a filler layer 61 of, for example, talc sandwiched therebetween. While the insulator 2 is pressed frontward into the metallic shell 1, the opening edge of the metallic shell 1 is crimped inward toward the packing 60 to thereby form a crimped portion 1*d*, whereby the metallic shell 1 is fixedly attached to the insulator 2.

Figure 3:
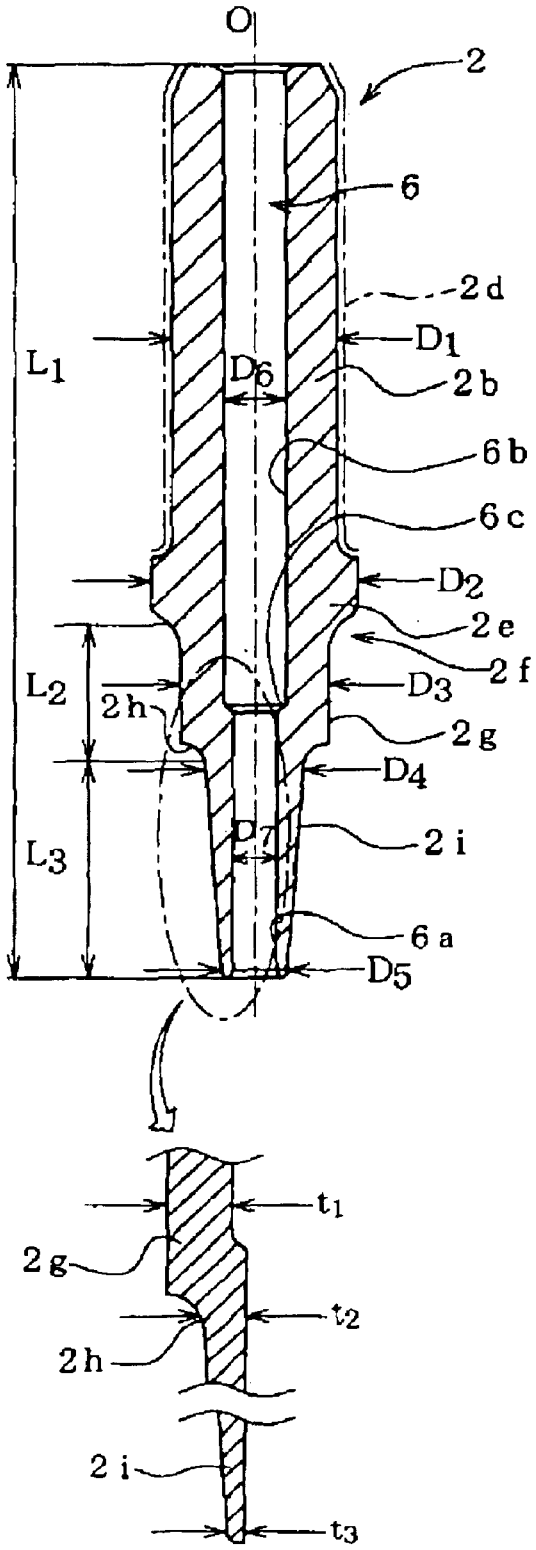
FIG. 3—vertical sectional views showing several embodiments of an insulator.
Figure 3:
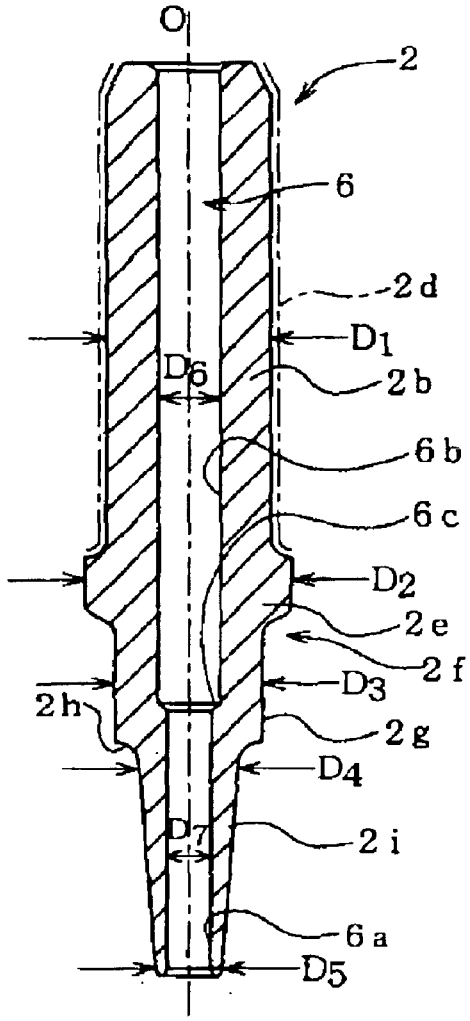

FIGS. 3(*a*) and 3(*b*) show examples of the insulator 2. Dimensions of portions of the insulator 2 are exemplified below.

Overall length L1: 30–75 mm

Length L2 of first shaft portion 2*g*: 0–30 mm (excluding a transitional portion 2*f* for transition to the circumferential protrusion 2*e* and including the transitional portion 2*h* for transition to the second shaft portion 2*i*)

Length L3 of second shaft portion 2*i*: 2–27 mm

Outside diameter D1 of body portion 2*b*: 9–13 mm

Outside diameter D2 of circumferential protrusion 2*e*: 11–16 mm

Outside diameter D3 of first shaft portion 2*g*: 5–11 mm

Outside diameter D4 of root part of second shaft portion 2*i*: 3–8 mm

Outside diameter D5 of tip part of second shaft portion 2*i* (when the outer circumferential edge of the tip face is rounded or chamfered, the outside diameter D5 is measured on a cross section including the center axis O at the position of the root of the rounded or chamfered portion): 2.5–7 mm Diameter D6 of second portion 6*a* of through-hole 6: 2–4 mm (the conductive seal material layers 16 and 17 are formed)

Diameter D7 of first portion 6*a* of through-hole 6: 1–3.5 mm

Wall thickness t1 of first shaft portion 2*g*: 0.5–4.5 mm

Wall thickness t2 of root part of second shaft portion 2*i* (as measured along the direction perpendicular to the center axis O): 0.3–3.5 mm Wall thickness t3 of tip part of second shaft portion 2*i* (as measured along the direction perpendicular to the center axis O; however, when the outer circumferential edge of the tip face is rounded or chamfered, the wall thickness t3 is measured on a cross section including the center axis O at the position of the root of the rounded or chamfered portion): 0.2–3 mm Average wall thickness tA of the second shaft portion 2*i* ((t2+t3)/2): 0.25–3.25 mm The above listed dimensions of the insulator 2 as shown in FIG. 3(*a*) are, for example, as follows: L1=approx. 60 mm; L2=approx. 10 mm; L3=approx. 14 mm; D1=approx. 11 mm; D2=approx. 13 mm; D3=approx. 7.3 mm; D4=approx. 5.3 mm; D5=4.3 mm; D6=3.9 mm; D7=2.6 mm; t1=3.3 mm; t2=1.4 mm; t3=0.9 mm; and tA=1.15 mm.

The insulator 2 as shown in FIG. 3(*b*) has the first shaft portion 2*g* and the second shaft portion 2*i* that are slightly greater in outside diameter than those of the insulator 2 of FIG. 3(*a*). The dimensions of the insulator 2 of FIG. 3(*b*) are, for example, as follows: L1=approx. 60 mm; L2=approx. 10 mm; L3=approx. 14 mm; D1=approx. 11 mm; D2=approx. 13 mm; D3=approx. 9.2 mm; D4=approx. 6.9 mm; D5=5.1 mm; D6=3.9 mm; D7=2.7 mm; t1=3.3 mm; t2=2.1 mm; t3=1.2 mm; and tA=1.65 mm.

The metallic terminal member 13 is inserted into a rear end portion of the through-hole 6 formed in the insulator 2, and is fixed therein; and the center electrode 3 is inserted into a front end portion of the through-hole 2 and fixed therein. The resistor 15 is disposed within the through-hole 6 between the metallic terminal member 13 and the center electrode 3. Opposite end portions of the resistor 15 are respectively connected to the center electrode 3 and to the metallic terminal member 13 via the conductive seal member layers 16 and 17. The resistor 15 is formed of a resistor composition, which is obtained through heating and pressing a mixture of a glass powder (a ceramic powder may be used instead as needed) and a conductive material powder in a glass seal step, which will be described later. Notably, without use of the resistor 15, the metallic terminal member 13 and the center electrode 3 may be united by means of a single conductive seal material layer.

The metallic terminal member 13 is formed of low-carbon steel or a like metal, and an Ni plating layer (e.g., 5 μm thick) is formed on the surface thereof for corrosion prevention. The metallic terminal member 13 includes a seal portion 13*c* (tip portion), a terminal portion 13*a* projecting from the rear end of the insulator 2, and a rodlike portion 13*b* for connecting the terminal portion 13*a* and the seal portion 13*c*. The seal portion 13*c* assumes an axially elongated cylindrical form, has protrusions like, for example, screw or ribs formed on the outer circumferential surface thereof, and is disposed in such a manner as to be plunged in the conductive seal material layer 17, whereby the conductive seal material layer 17 seals against the seal portion 13*c* and against the inner surface of the through-hole 6. A clearance of about 0.1–0.5 mm is formed between the outer circumferential surface of the seal portion 13*c* and the inner surface of the through-hole 6.

The conductive seal material layers 16 and 17 are essential portions of the spark plug of the present invention, and contain base glass, a conductive filler, and an insulative filler. As in the case of a conventional conductive seal material, the base glass is glass that contains a predominant amount of oxide, such as borosilicate glass. The conductive filler is, for example, a metal powder which contains a predominant amount of one or more metal components such as Cu and Fe. The insulative filler is an oxide-type inorganic material formed by use of one or more substances selected from among β-eucryptite, β-spodumene, keatite, silica, mullite, cordierite, zircon, aluminum titanate, etc.

Figure 2:
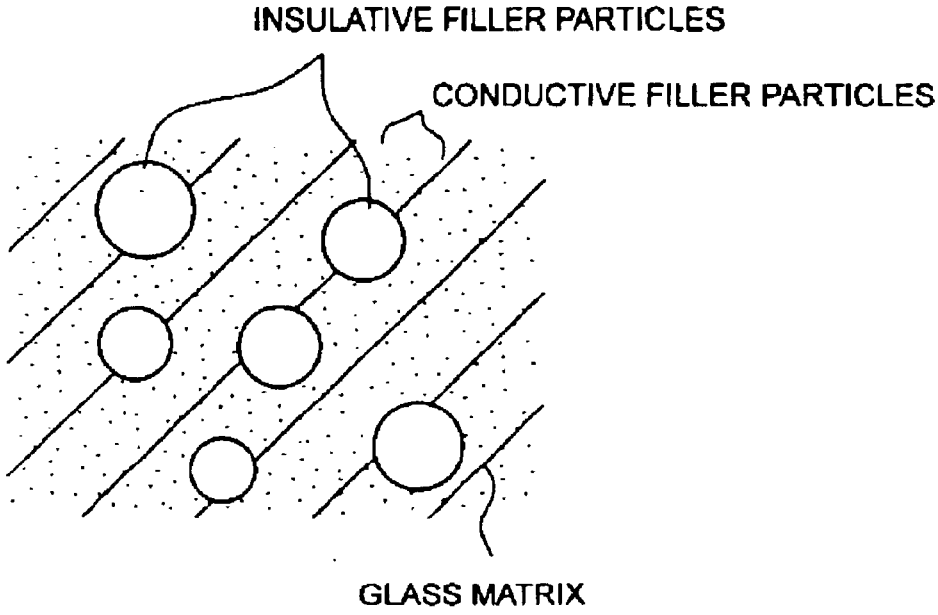
FIG. 2 is a schematic view showing the microstructure of a conductive seal material layer.

As described previously, in the spark plug 100, the diameter of the through-hole 6 as measured at the position of the conductive seal material layer 16 or 17; i.e., the diameter D6 of the second portion 6*b*, is not greater than 4 mm; and the components and microstructure of the conductive seal material layers 16 and 17 are adjusted such that the coefficient of linear expansion thereof is lower than that of alumina; specifically, less than $6.8\times10^{-6}$/° C. FIG. 2 schematically shows a preferred microstructural form of the conductive seal material layers 16 and 17. As shown in FIG. 2, conductive filler particles are dispersed in base glass, which serves as glass matrix, to thereby form network-like conductive paths, whereas a large portion (e.g., not less than 60% by volume) of insulative filler particles as observed at the mixing stage remain and are dispersed in the form of crystalline particles without being melted into the base glass. Since insulative filler particles of the above-mentioned material have high softening point, excessive melting of insulative filler particles into base glass causes an increase in the softening point of glass, resulting in a drop in fluidity and thus raising a relevant problem such as a failure to establish sufficient sealing performance.

Figure 4:
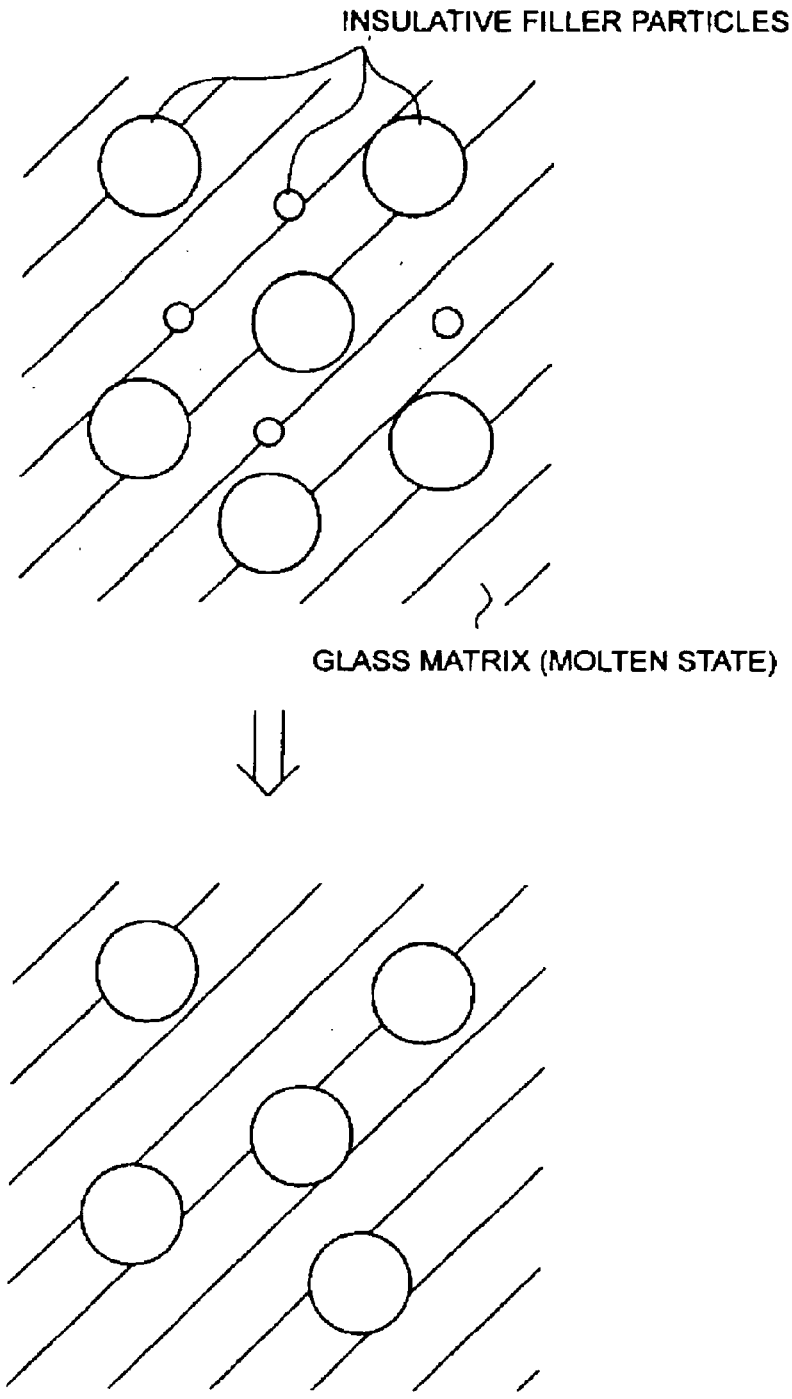
FIG. 4 is a schematic view showing behavior of insulative filler particles of small particle size contained in a conductive seal material in a sealing step.

Insulative filler particles having a particle size less than 50 μm as measured in the mixing stage for preparation of a seal material (i.e., as measured before the sealing step is performed) tend to be melted into base glass, which serves as glass matrix, as shown in FIG. 4; therefore, when such insulative filler particles are contained in an excessive amount, the softening point of glass tends to increase excessively. Meanwhile, the glass matrix realizes the seal function of the conductive seal material layers 16 and 17 on a seal surface between the insulator 2 and the metallic terminal member 13 and on that between the insulator 2 and the center electrode 3. Insulative filler particles present on the seal surfaces form non-seal regions, which do not participate in realizing the seal function. When insulative filler particles having a particle size in excess of 350 μm are present on the seal surfaces, the particles form locally large non-seal regions. When non-seal regions are formed in a large amount, sealing performance is impaired. For these reasons, preferably, in the mixing stage for preparation of a seal material, insulative filler particles having a particle size less than 50 μm are contained in an amount not greater than 10% by mass, and insulative filler particles having a particle size in excess of 350 μm are contained in an amount not greater than 5% by mass. The particle size of insulative filler particles associated with the mixing stage means that as measured by use of standard sieves; specifically, particles that pass through a sieve having apertures (represented by an inside measurement between adjacent wires) of 50 μm have a particle size less than 50 μm, and particles that do not pass through a sieve having apertures of 350 μm have a particle size in excess of 350 μm.

Preferably, the conductive seal materials 16 and 17 contain the insulative filler in an amount of 2–40% by mass. When the insulative filler content is less than 2% by mass, the added insulative filler fails to yield the effect of adjusting the coefficient of linear expansion of the seal material. When the insulative filler content exceeds 40% by mass, fluidity of the seal material is impaired with a resultant failure to provide good sealing performance or to impart sufficient bonding strength to a seal portion.

Through use of the above-described insulative filler, the conductive seal material layers 16 and 17 can be formed such that, in a microstructure thereof as observed on a cross section thereof, insulative filler particles having a particle size of 100–350 μm occupy an area percentage of 2–40% in the microstructure. Formation of such a microstructure enhances considerably the sealing performance and durability of the conductive seal material layers 16 and 17, and thus good gastightness can be maintained over a long period of time.

Metal powder particles which serve as the conductive filler have an average particle size of 20–40 μm, and are contained in the seal material in an amount of, for example, 35–70% by mass. When the average particle size is less than 20 μm, chemical stability is impaired, and oxidational deterioration or a like problem arises with a resultant difficulty in establishing required electrical conductivity. When the average particle size exceeds 40 μm, resistivity distribution becomes nonuniform, and fluidity tends to be impaired in the sealing step. When the metal powder content is less than 35% by mass, there arises difficulty in establishing required electrical conductivity. When the metal powder content exceeds 70% by mass, not only does the base glass content become insufficient to maintain sealing performance, but also the coefficient of linear expansion of the conductive seal material layers 16 and 17 increases excessively, with a resultant failure to yield sufficiently the aforementioned effect of the present invention.

Referring back to FIG. 1, a body portion 4*a* of the ground electrode 4 and a body portion 3*a* of the center electrode 3 are formed of, for example, an Ni alloy or an Fe alloy. In order to accelerate heat radiation, a core 3*b* of Cu, a Cu alloy, or a like metal is embedded in the body portion 3*a* of the center electrode 3. The facing spark portions 31 and 32 are formed primarily of a noble metal alloy which contains a predominant amount of one or more noble metals selected from among Ir, Pt, and Rh. Notably, either or both of the spark portions 31 and 32 may be omitted.

The above-described spark plug 100 can be manufactured by, for example, the method to be described below. First, a method for manufacturing the insulator 2 is described. A material powder is a mixture of an alumina power, an Si component material powder, a Ca component material powder, an Mg component material powder, a Ba component material powder, and a B component material powder. The proportions of these component material powders are determined so as to attain, after firing, the aforementioned composition as reduced to the respective oxides. A binder (e.g., PVA) and water are added in respectively predetermined amounts to the mixture, followed by mixing to yield a forming material slurry. The component material powders can be, for example, $SiO_2$ powder for the Si component, $CaCO_3$ powder for the Ca component, MgO powder for the Mg component, $BaCO_3$ powder for the Ba component, and $H_3BO_3$ powder for the B component. Notably, $H_3BO_3$ can assume the form of solution.

The forming material slurry is spray-dried by a spray-drying process or a like process, thereby obtaining forming material granules. The forming material granules are rubber-pressed into a green body for the insulator. The rubber-pressing process uses a rubber die having a cavity extending axially therethrough. A lower punch is fitted into a lower opening portion of the cavity. A press pin projects unitarily from the punch face of the lower punch in such a manner as to extend axially within the cavity, and specifies the shape of the through-hole 6 of the insulator 2.

In the above-mentioned state, forming material granules are filled in a predetermined amount into the cavity, and then an upper opening portion of the cavity is closed with an upper punch to thereby be sealed. In this state, liquid pressure is applied to the outer circumferential surface of the rubber die, thereby compressing the granules contained in the cavity via the rubber die and thus obtaining a green body. In order to accelerate pulverization of the granules into powder particles in the course of pressing, water is added to the forming material granules in an amount of 0.7–1.3 parts by mass per 100 parts by mass of the forming material granules before pressing. The outer surface of the obtained green body is subjected to, for example, grinding to thereby be finished to a profile (see FIG. 3) corresponding to the insulator 2. Next, the green body is fired at a temperature of 1400–1600° C. for 1–8 hours in the atmosphere, thereby yielding the insulator 2.

Figure 5:
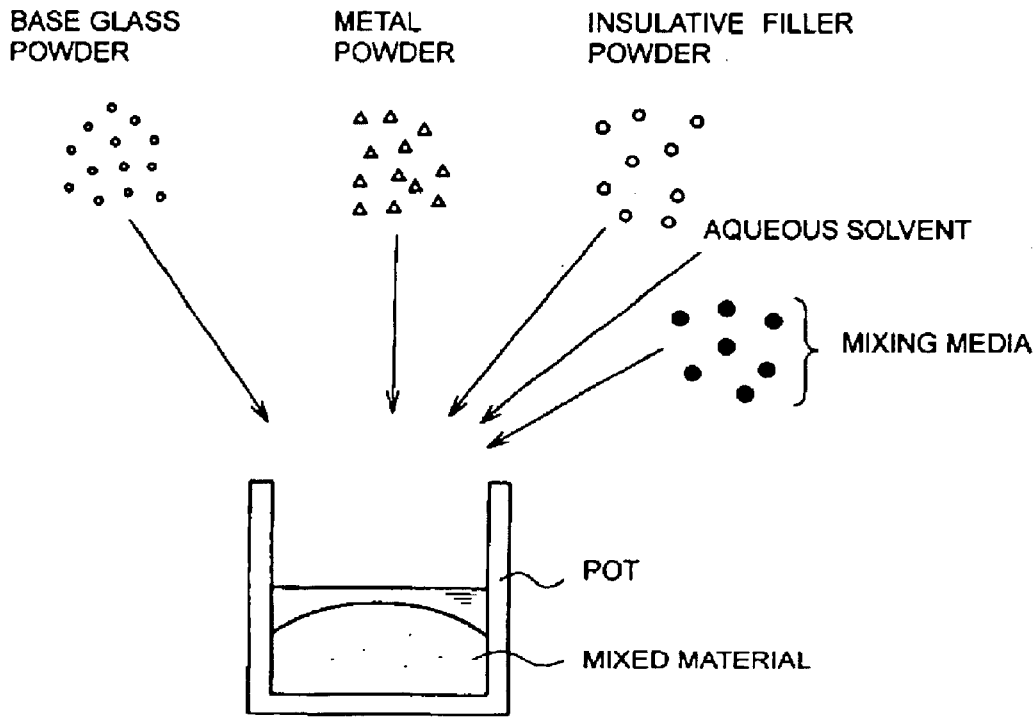
FIG. 5—explanatory views showing steps of manufacture of the spark plug of FIG. 1.
Figure 5:
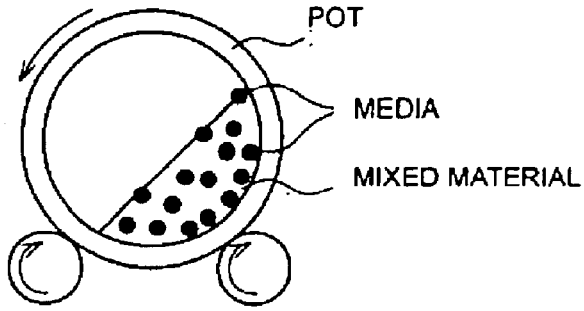

Next, a conductive seal material powder is prepared in the following manner. As shown in FIG. 5(*a*), a base glass powder, a metal powder, which serves as a conductive filler powder, and an insulative filler powder are mixed in respectively predetermined amounts, thereby yielding a mixed material. The mixed material, together with an aqueous solvent and mixing media (e.g., media of ceramic such as alumina), is placed in a mixing pot. Then, as shown in FIG. 5(*b*), the pot is rotated, thereby mixing and dispersing the material uniformly. Use of the aforementioned oxide-type insulative filler powder enhances dispersibility in the course of mixing by use of an aqueous solvent and thus realizes better fluidity in the course of softening. Therefore, there can be obtained homogeneous conductive seal material layers 16 and 17 which are less prone to uneven distribution of particles or a like defect.

Figure 6:
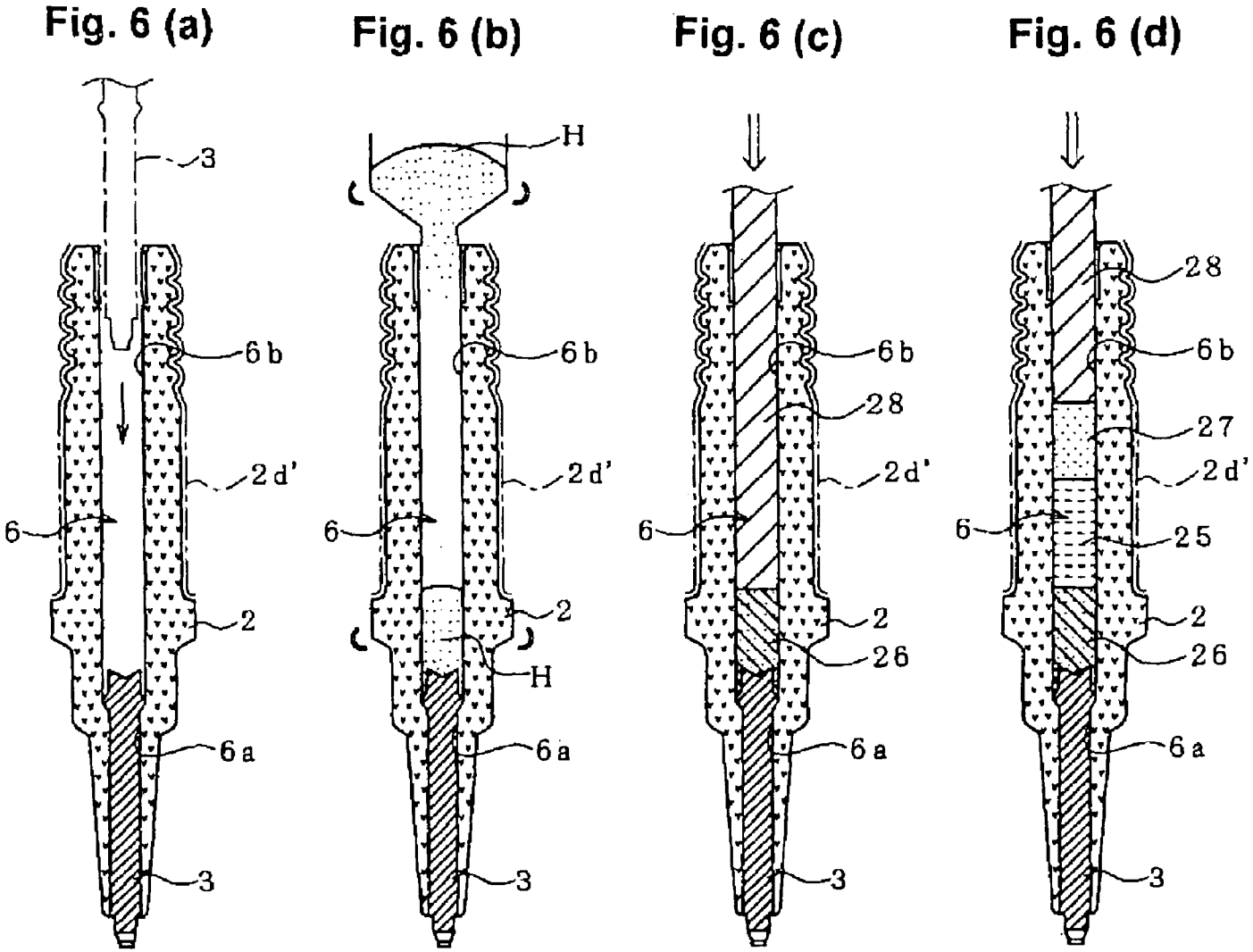
FIG. 6—explanatory views showing steps of manufacture subsequent to those of FIG. 5.

In the glass sealing step to be described below, the center electrode 3 and the metallic terminal member 13 are attached to the insulator 2, and the resistor 15 and the conductive seal material layers 16 and 17 are formed. First, a glaze slurry is sprayed, from a spray nozzle, on the insulator 2 over a required surface to thereby form a glaze slurry layer 2*d*', which will become the glaze layer 2*d* in FIG. 1, followed by drying. Next, as shown in FIG. 6(*a*), the center electrode 3 is inserted into the first portion 6*a* of the through-hole 6 formed in the insulator 2, and then as shown in FIG. 6(*b*), a conductive seal material powder H is placed in the through-hole 6. As shown in FIG. 6(*c*), a presser bar 28 is inserted into the through-hole 6 so as to compress the powder H preliminarily, thereby forming a first conductive seal material powder layer 26. Next, a material powder of resistor composition is placed in the through-hole 6 from the rear end of the insulator 2 and undergoes preliminary compression in a similar manner. Further, a conductive seal material powder is placed in the through-hole 6, followed by similar preliminary compression by use of the presser bar 28. As a result, as shown in FIG. 6(*d*), in the ascending order from the center electrode 3 (from the bottom), the first conductive seal material powder layer 26, a resistor composition powder layer 25, and a second conductive seal material powder layer 27 are arranged in layers within the through-hole 6.

Figure 7:
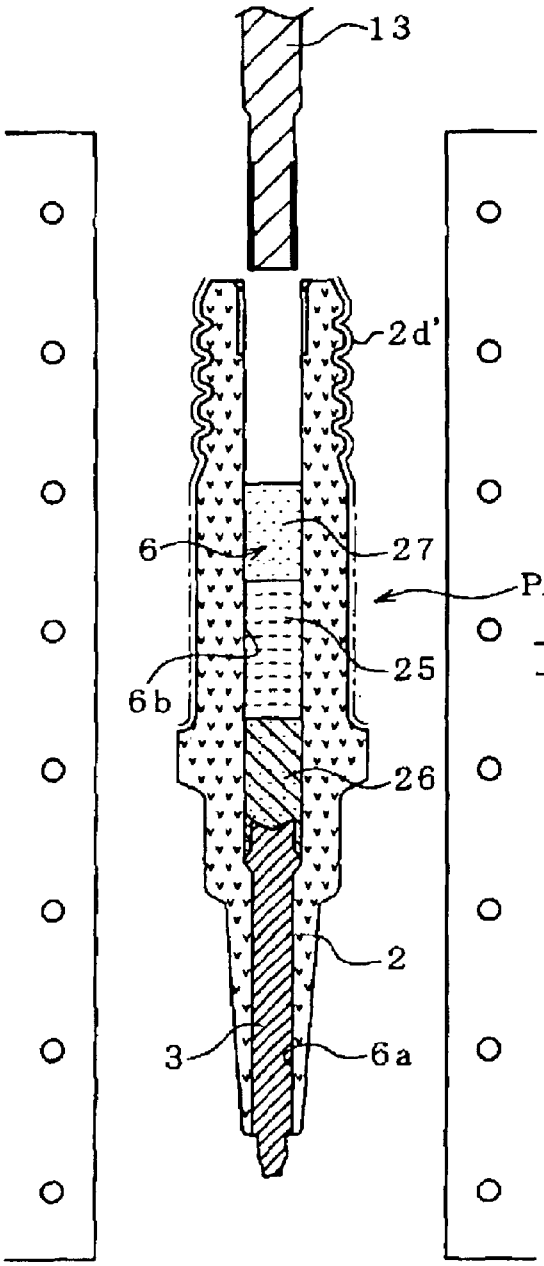
FIG. 7—explanatory views showing steps of manufacture subsequent to those of FIG. 6.
Figure 7:
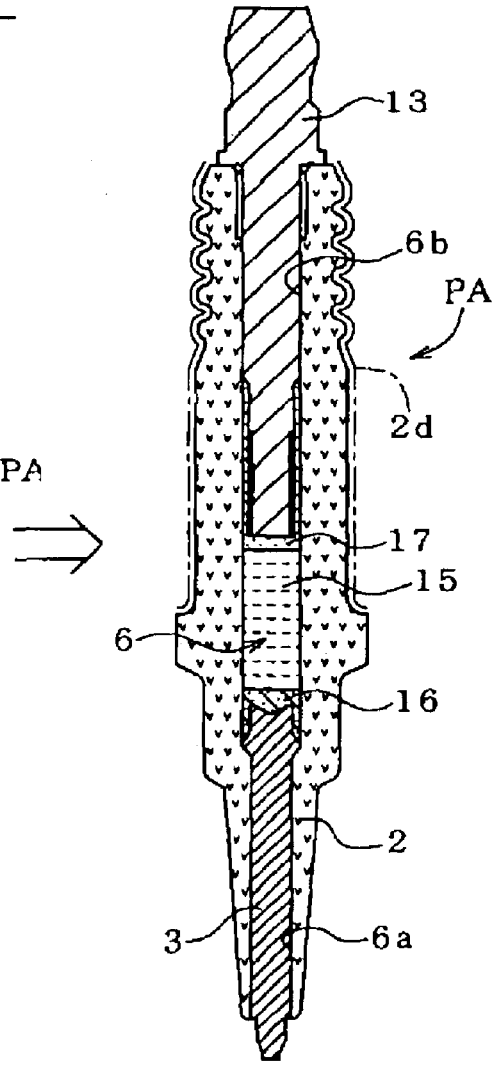
Figure 8:
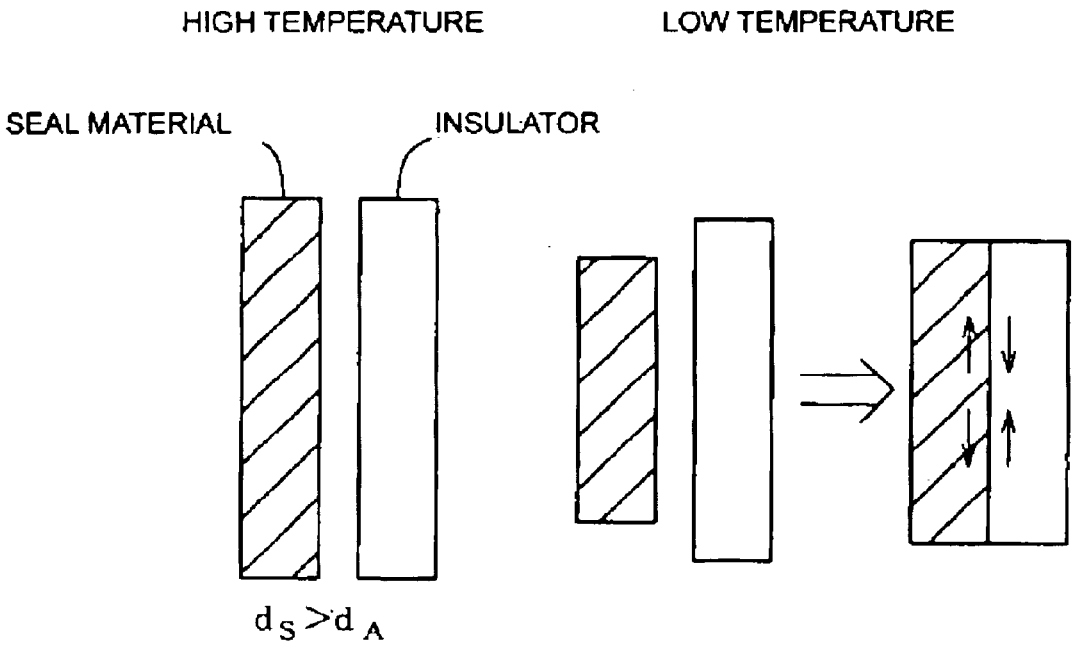
FIG. 8—explanatory views showing the action of a conductive seal material layer.
Figure 8:
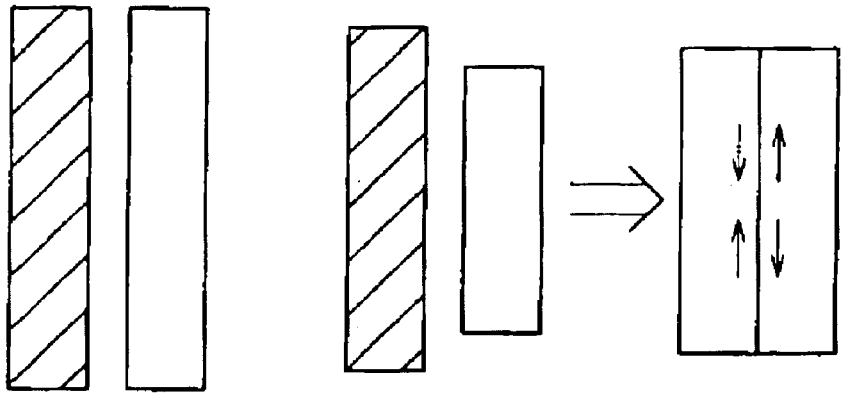

Then, as shown in FIG. 7(*a*), the metallic terminal member 13 is fitted into the through-hole 6 from the rear end of the insulator 2, thereby yielding an assembly PA. The assembly PA is placed in a heating furnace and heated at a predetermined temperature of 700–950° C. Subsequently, the metallic terminal member 13 fitted in the through-hole 6 is axially pressed toward the center electrode 3, thereby pressing the layers 25–27 axially. As a result, as shown in FIG. 7(*b*), the layers are compressed and sintered to become the conductive seal material layer 16, the resistor 15, and the conductive seal material layer 17 (sealing step). When this sealing step is to be applied, preferably, the base glass powder, the metal powder, and the insulative filler powder are adjusted in terms of mixing proportions and particle size such that the conductive seal material powder has an apparent softening point of 500° C.–1000° C. When the softening point is lower than 500° C., heat resistance of the conductive seal material layers 16 and 17 may become insufficient. When the softening point is higher than 1000° C., sealing performance may become insufficient. Notably, the softening point is obtained in the following manner. 50 milligrams of powder sample are subjected to differential thermal analysis through application of heat, and the softening point of the sample is a temperature corresponding to the second endothermic peak which appears after start of measurement at room temperature. At this time, the glaze slurry layer 2*d*', which has been applied in the glass sealing step, is simultaneously fired to become the glaze layer 2*d*.

To the assembly PA which has undergone the glass sealing step, the metallic shell 1, the ground electrode 4, and other components are attached, thereby completing the spark plug 100 shown in FIG. 1. The spark plug 100 is mounted on an engine block through engaging the male-threaded portion 7 with the engine block, and used as an ignition source for igniting air-fuel mixture to be supplied into a combustion chamber.

In order to confirm the effect of the present invention, the following experiments were carried out.

The insulator 2 was manufactured in the following manner. To alumina powder (alumina 95 mol %; Na content (as reduced to $Na_2O$) 0.1 mol %; average particle size 3.0 μm), $SiO_2$ (purity 99.5%; average particle size 1.5 μm), $CaCO_3$ (purity 99.9%; average particle size 2.0 μm), MgO (purity 99.5%; average particle size 2 μm), $BaCO_3$ (purity 99.5%; average particle size 1.5 μm), and $H_3BO_3$ (purity 99.0%; average particle size 1.5 μm) were added in predetermined mixing proportions, thereby obtaining a material powder. To 100 parts by mass material powder, 3 parts by mass PVA, which serves as a hydrophilic binder, and 103 parts by mass water were mixedly added, thereby yielding a forming material slurry.

Next, the forming material slurry was spray-dried, thereby yielding spherical forming material granules. The forming material granules were sieved so as to collect granules having a particle size of 50–100 μm. The granules were subjected to the previously described rubber-pressing process at 50 MPa, thereby yielding green bodies for insulators. The outer surface of each of the green bodies was subjected to grinding to thereby be finished to a predetermined insulator profile. Then, the green bodies were fired at 1550° C. for two hours, thereby yielding the insulators 2 (D6=3.9 mm) of FIG. 3(*a*). Notably, X-ray spectrometric analysis revealed that the insulators 2 had the following composition:

Al component: 94.9 mol % as reduced to $Al_2O_3$;

Si component: 2.4 mol % as reduced to $SiO_2$;

Ca component: 1.9 mol % as reduced to CaO;

Mg component: 0.1 mol % as reduced to MgO;

Ba component: 0.4 mol % as reduced to BaO; and

B component: 0.3 mol % as reduced to $B_2O_3$.

Next, a mixture of a Cu powder (average particle diameter 30 μm) and an Fe powder (average particle diameter 30 μm), which are mixed at the mass ratio 1:1, and a base glass powder (average particle diameter 150 μm) were mixed such that the metal powder content was about 50% by mass, thereby yielding a conductive glass mixture. The base glass powder was of borosilicate soda glass, which was obtained through mixing and melting 60% by mass $SiO_2$, 30% by mass $B_2O_5$, 5% by mass $Na_2O$, and 5% by mass BaO. The softening temperature of the glass was 750° C. To the conductive glass mixture, the insulative filler—which was formed of one oxide-type inorganic material selected from among β-eucryptite, β-spodumene, keatite, silica, mullite, cordierite, zircon, and aluminum titanate—was added in various proportions. By use of the resultant mixtures, various kinds of conductive seal materials were formed through mixing and drying as illustrated in FIG. 5. Particle size distribution of each kind of insulative filler was adjusted through sieving and subsequent re-blending as follows: particles having a particle size not less than 150 μm and less than 250 μm 40% by mass; particles having a particle size not less than 106 μm and less than 150 μm 40% by mass; particles having a particle size not less than 50 μm and less than 106 μm 15% by mass; and particles having a particle size less than 50 μm 5% by mass.

The resistor material powder was prepared in the following manner. 30% By mass fine glass powder (average particle size 80 μm), 66% by mass $ZrO_2$ (average particle size 3 μm) as ceramic powder, 1% by mass carbon black, and 3% by mass dextrin as organic binder were mixed. The resultant mixture and water as solvent were wet-mixed by use of a ball mill, followed by drying to thereby obtain a preliminary material. 20 Parts by mass preliminary material and 80 parts by mass coarse glass powder (average particle size 250 μm) were mixed, thereby obtaining a resistor material powder. Notably, the glass powder was of borosilicate lithium glass, which was obtained through mixing and melting 50% by mass $SiO_2$, 29% by mass $B_2O_5$, 4% by mass $Li_2O$, and 17% by mass BaO. The softening temperature of the glass was 585° C.

Next, by use of the thus-prepared conductive seal material powders and resistor composition powder, various kinds of sample resistor-incorporated spark plugs 100 as shown in FIG. 1 were manufactured. The conductive seal material powder was placed in an amount of 0.15 g for forming the conductive seal material powder layer 26; the resistor material powder was placed in an amount of 0.40 g; and the conductive seal material powder was placed in an amount of 0.15 g for forming the conductive seal material powder layer 27. In the hot pressing process, heating temperature was 900° C., and a pressure of 100 kg/cm$^2$ was applied.

The coefficient of linear expansion was measured for individual conductive seal material powders in the following manner. Conductive seal material layers were removed from the corresponding insulators 2 by removing the surrounding insulators 2 through grinding along the circumferential direction. From the thus-obtained conductive seal material layers, samples each having a diameter of 3–4 mm and a height of 2–4 mm were cut away. By use of the samples and a known differential dilatometer, the coefficient of linear expansion was obtained as the average of linear expansion coefficient values as measured over the temperature range of from 20° C. to 350° C. Samples of the same size were also cut away from the insulators 2, and the coefficient of linear expansion was obtained in the similar manner. It was $7.3\times10^{-6}$/° C.

Figure 9:
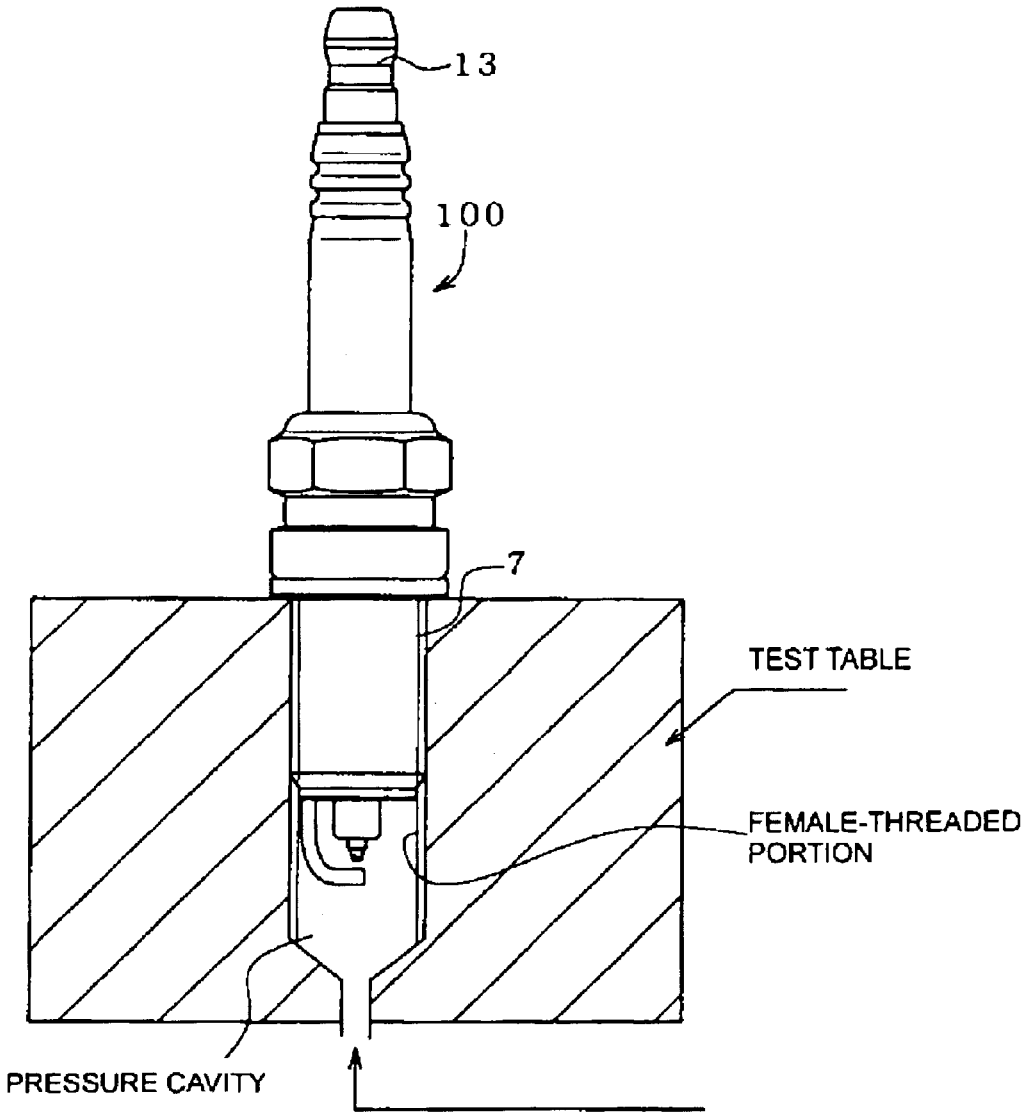
FIG. 9 is a view showing a test setup for evaluating sealing performance.

As shown in FIG. 9, each of the thus-manufactured sample spark plugs (100 pieces for each of design conditions) was mounted on the pressure test table by engaging the male-threaded portion 7 thereof with a female-threaded portion of a pressure cavity formed in the pressure test table. Sealing performance was evaluated in the following manner: compressed air was introduced into the pressure cavity at two pressure levels, 1.5 MPa (standard test) and 2.5 MPa (accelerated test); air leakage from the side toward the metallic terminal member 13 was measured; and a sample spark plug having a leakage of 0.5 ml/min or more was evaluated as a leaking sample. Table 1 shows the test results (the number of leaking samples out of 100 samples is shown) in the case where the insulative filler was of cordierite, and the cordierite content of the seal material was varied. As is apparent from Table 1, employment of a cordierite content not less than 5% by mass can impart a coefficient of linear expansion less than $6.8\times10^{-6}$/° C. to the conductive glass seal materials. Also, employment of such a linear expansion coefficient value enhances sealing performance as observed at the accelerated test; in particular, employment of a coefficient of linear expansion not greater than $5.1\times10^{-6}$/° C. exhibits still better test results.

TABLE 1

| Measuring condition | Insulative filler content (% by mass) | 0 | 5 | 10 | 15 | 20 | 25 | 30 |
|---|---|---|---|---|---|---|---|---|
| | Insulative filler: cordierite | | | | | | | |
| | Average coefficient of linear expansion of adjusted seal glass ($10^{-6}$/° C.) | 6.8 | 6.3 | 5.6 | 5.1 | 4.5 | 4.1 | 3.7 |
| 1.5 MPa | Number of leaking samples/number of tested samples | 0/100 | 0/100 | 0/100 | 0/100 | 0/100 | 0/100 | 0/100 |
| | Incidence (%) | 0% | 0% | 0% | 0% | 0% | 0% | 0% |
| 2.5 MPa | Number of leaking samples/number of tested samples | 40/100 | 15/100 | 3/100 | 0/100 | 0/100 | 0/100 | 0/100 |
| | Incidence (%) | 40% | 15% | 3% | 0% | 0% | 0% | 0% |

Next, Table 2 shows the results of the test that was conducted in a manner similar to that of Table 1 except that various kinds of insulative fillers of other than cordierite were contained in the respective seal materials in an amount of 15% by mass. As is apparent from Table 2, a coefficient of linear expansion less than $6.8\times10^{-6}$/° C. is attained for all the tested insulative fillers, indicating that good sealing performance is provided. The similar test was also conducted by use of insulative fillers of silica and keatite, which are not contained in Table 2 and whose content was adjusted to attain a coefficient of linear expansion less than $6.8\times10^{-6}$/° C., and yielded the following results: none of 10 tested samples was evaluated as a leaking sample at the two pressure levels, 1.5 MPa (standard test) and 2.5 MPa (accelerated test), indicating that good sealing performance is provided.

TABLE 2

| Measuring condition | Insulative filler | Zircon | Mullite | Eucryptite | Spodumene | Aluminum titanate |
|---|---|---|---|---|---|---|
| | Insulative filler content: 15% by mass | | | | | |
| | Average coefficient of linear expansion of adjusted seal glass ($10^{-6}$/°C.) | 6.5 | 6.4 | 5.3 | 4.5 | 3.7 |
| 1.5 MPa | Number of leaking samples/number of tested samples | 0/100 | 0/100 | 0/100 | 0/100 | |
| | Incidence (%) | 0% | 0% | 0% | 0% | |
| 2.5 MPa | Number of leaking samples/number of tested samples | 0/100 | 0/100 | 0/100 | 0/100 | 0/100 |
| | Incidence (%) | 0% | 0% | 0% | 0% | |

Table 1 shows the results of the test that was conducted under the condition that the through-hole formed in the insulator has a diameter D6 of 3.9 mm. Table 3 shows the results of the test (accelerated test) that was conducted in a mariner similar to that of Table 1 except that insulators of different D6 values were used while outside dimensions of the insulators were held unchanged. As is apparent from Table 3, when the diameter D6 is in excess of 4 mm, for example, 5 mm, no problem arises in terms of sealing performance, indicating that the effect of the present invention is yielded as expected at a D6 value not greater than 4 mm.

TABLE 3

| Hole diameter (mm) | Content (% by mass) 0 | 5 | 10 | 15 |
|---|---|---|---|---|
| | Insulative filler: cordierite | | | |
| 3.0 | 54/100 | 17/100 | 5/100 | 0/100 |
| 3.5 | 45/100 | 15/100 | 3/100 | 0/100 |
| 3.9 | 40/100 | 15/100 | 3/100 | 0/100 |
| 5.0 | 0/100 | 0/100 | 0/100 | 0/100 |

What is claimed is:

1. A spark plug in which a metallic terminal member and a center electrode are securely and rigidly held, via a conductive seal material, within a through-hole formed axially in an insulator, wherein:

the insulator is formed of alumina ceramic; a diameter of the through-hole is not greater than 4 mm as measured at a position where the conductive seal material is disposed; and a coefficient of linear expansion of the conductive seal material is adjusted to lower than the coefficient of liner expansion of the insulator, and is less than $6.8\times10^{-6}$/° C.

2. The spark plug as described in claim 1, wherein the conductive seal material contains base glass, a conductive filler, and an insulative filler, and the insulative filler is formed of an inorganic material having a coefficient of linear expansion lower than that of aluminum oxide.

3. The spark plug as described in claim 2, wherein the insulative filler is formed of an inorganic material having a coefficient of linear expansion lower than that of the base glass.

4. The spark plug as described in claim 2, wherein the insulative filler is formed of an oxide-type inorganic material.

5. The spark plug as described in claim 2, wherein, in a microstructure of the conductive seal material as observed on a cross section thereof, insulative filler particles having a particle size in the range of from 100 to 350 $\mu$m occupy an area percentage in the range of from 2 to 40% in the microstructure.

6. The spark plug as described in claim 5, wherein the coefficient of linear expansion of the conductive seal material is adjusted to be in the range of from $3.0\times10^{-6}$/° C. to $6.5\times10^{-6}$/° C.

7. The spark plug as described in claim 2, wherein the conductive seal material contains the insulative filler in an amount in the range of from 2 to 40% by mass.

8. The spark plug as described in claim 2, wherein the insulative filler is contained such that insulative filler particles having a particle size less than 50 $\mu$m are contained in an amount not greater than 10% by mass, and insulative filler particles having a particle size in excess of 350 $\mu$m are contained in an amount not greater than 5% by mass.

9. The spark plug as described in claim 2, wherein one or more substances from the group consisting of β-eucryptite, β-spodumene, keatite, silica, mullite, cordierite, zircon, and aluminum titanate are used to form the insulative filler.

* * * * *